United States Patent [19]

Muntean et al.

[11] 4,369,750

[45] Jan. 25, 1983

[54] FUEL INJECTOR FOR INTERNAL COMBUSTION ENGINE

[75] Inventors: George Muntean; Harry L. Wilson; Gary L. Gant, all of Columbus, Ind.

[73] Assignee: Cummins Engine Company, Inc., Columbus, Ind.

[21] Appl. No.: 105,150

[22] Filed: Dec. 19, 1979

[51] Int. Cl.[3] ..... F02M 59/42

[52] U.S. Cl. ..... 123/505; 123/198 DB; 239/90

[58] Field of Search ..... 123/198 DB, 325, 338, 123/371, 394, 397, 367, 391, 389, 388, 376, 505, 320, 382; 239/88, 89, 90, 91, 92, 538; 417/494

[56] References Cited

U.S. PATENT DOCUMENTS

| | | | |
|---|---|---|---|
| 2,598,528 | 5/1952 | French | 239/92 |
| 2,793,076 | 5/1957 | Brehmer | 239/90 |
| 3,006,556 | 10/1961 | Shade | 239/90 |
| 3,351,288 | 11/1967 | Perr | 239/90 |
| 3,734,069 | 5/1973 | Akiyama | 123/505 |
| 3,908,624 | 9/1975 | Miyake | 123/505 |
| 4,083,346 | 4/1978 | Eheim | 123/198 DB |

FOREIGN PATENT DOCUMENTS

| | | | |
|---|---|---|---|
| 508819 | 8/1958 | Italy | 417/494 |

*Primary Examiner*—Charles J. Myhre
*Assistant Examiner*—Carl Stuart Miller
*Attorney, Agent, or Firm*—Merriam, Marshall & Bicknell

[57] ABSTRACT

This disclosure relates to a fuel injector for an internal combustion engine. The injector comprises an injector body forming a plunger bore, and a plunger reciprocably mounted in the bore. The plunger reciprocates between a retracted position and a forward position, and a fuel receiving or metering chamber is formed at the forward end of the bore when the plunger is in the retracted position. A fuel supply passage is formed in the body and conducts fuel to the chamber when the plunger is in the retracted position. When the plunger is moved forwardly in an injection stroke, it ejects the fuel from the chamber through spray holes formed in the body. The injector further includes means for selectively opening or closing the supply passage when the injector plunger is in the retracted position. Such means includes a land formed on the plunger adjacent the supply passage, a groove formed in the land, and means for rotating the plunger between two angular positions. When the plunger is retracted and the plunger is in one angular position, the groove connects the supply passage to the chamber and in the other position the groove is displaced from the passage and the land closes the passage.

12 Claims, 6 Drawing Figures

FUEL INJECTOR FOR INTERNAL COMBUSTION ENGINE

U.S. Pat. No. 3,351,288 issued Nov. 7, 1967 discloses a fuel injector for an internal combustion engine including an injector body forming a plunger bore, and a plunger reciprocably mounted in the bore and movable between a retracted and a forward position. When in the retracted position, a metering chamber is formed at one end of the bore and a fuel supply passage formed in the injector body conducts fuel to the metering chamber. During the next injection stroke of the plunger from the retracted position to the forward position, the plunger moves through the metering chamber and ejects the fuel from the chamber through spray holes under very high pressure.

An injector generally similar to that disclosed in the above patent has been in commercial use for many years and has been highly successful. Nevertheless, its performance could be improved during certain engine operating conditions. When the engine is motoring or is in engine braking operation, the engine throttle permits only a small amount of fuel to flow to the injectors. Under these conditions, during each compression stroke of a piston, hot air and combustion gases under high pressure may enter the injector through the spray holes. The injector parts and the small amount of fuel in the injector are heated, which can produce carboning.

In addition to patent No. 3,351,288, the following U.S. patents may also be considered pertinent: No. 3,544,008, No. 4,149,506, No. 2,052,459, No. 2,144,862, No. 2,464,288, No. 2,518,901, No. 2,521,224, No. 2,793,076, No. 2,890,657, No. 2,951,643, No. 3,093,210, No. 3,346,188, and No. 3,368,491.

It is a general object of the present invention to provide an improved injector construction which avoids the foregoing disadvantages.

A fuel injector in accordance with the present invention comprises an injector body having a plunger bore formed therein, a plunger reciprocably mounted within said bore and movable between a retracted position and a forward position, a fuel supply passage formed in said injector body, said injector bore forming a fuel metering chamber at the forward end thereof when said plunger is in said retracted position, said supply passage including an outlet leading to said metering chamber, and means closing said outlet under selected operating conditions, said means comprising a metering land formed on said plunger, a metering groove formed in said land, and means for angularly turning said plunger between open and closed positions. When said plunger is retracted and is in said open position, said groove connects said outlet of said supply passage with said metering chamber and when said plunger is in said closed angular position, said groove is displaced from said outlet and said land closes said outlet. Various means may be provided for angularly rotating said plunger, including vane means and a rack and pinion arrangement.

The foregoing and other objects and advantages of the present invention may be better understood from the following detailed description taken in conjunction with the accompanying figures of the drawings, wherein.

Figure 1:
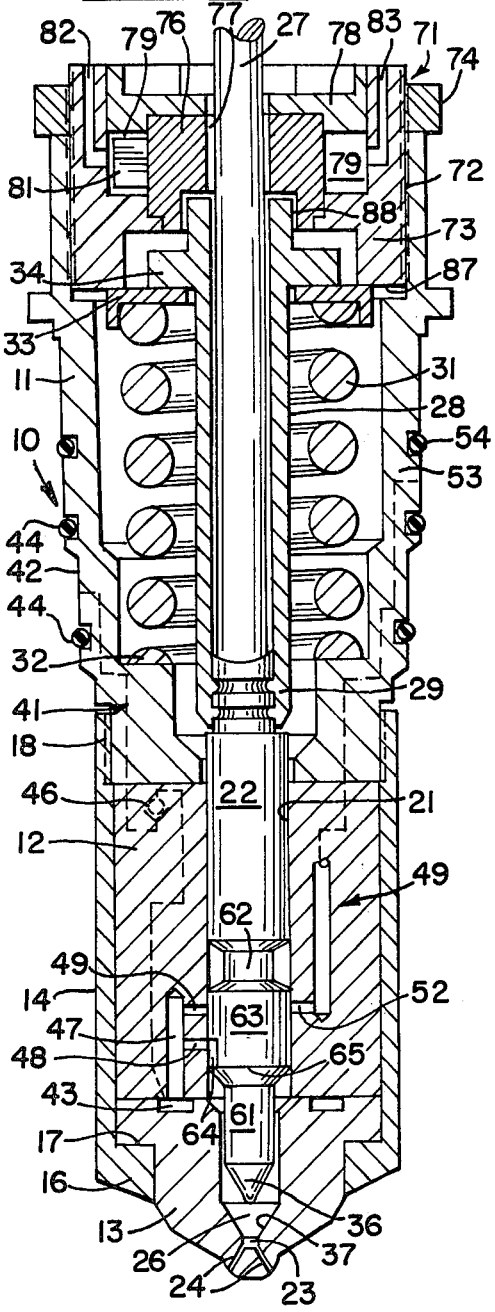
FIG. 1 is a sectional view of an injector embodying the present invention.

With reference to FIGS. 1 through 4 of the drawings, the injector comprises a body 10 formed by a body part 11, a barrel 12, a cup or nozzle 13, and a cylindrical retainer 14 which secures the parts 11, 12 and 13 together. The retainer 14 includes an inwardly extending flange 16 that connects with a ledge 17 formed on the cup 13, the retainer 14 enclosing the barrel 12 and being connected to the body part 11 by threads 18.

The injector body 10 has an axially extending plunger bore 21 formed through it which receives a reciprocable plunger 22. The bore 21 extends through the part 11 and the barrel 12 and forwardly into the cup 13. At the forward end of the plunger bore 21, in the cup 13, is formed a sac 23 and spray holes 24 which connect the forward end of the bore 21 with a cylinder of an engine in which the injector is mounted. The plunger 22 reciprocates between a forward position shown in FIG. 2 and a retracted position shown in FIGS. 1 and 3, and when the plunger is in the retracted position a fuel receiving or metering chamber 26 is formed at the forward end of the bore 21. As described and shown in the above-mentioned patent, an injector drive train is connected to the upper end of the plunger 22 by a cam driven link 27 that is forced downwardly to move the injector plunger 22 in an injection stroke at the appropriate time in each engine cycle. The link 27 has its lower end in engagement with the upper end of the plunger 22 and a plunger coupling 28 surrounds the lower end of the link 27. The lower end of the coupling 28 is secured to the upper end of the plunger 22 as by crimping in the area indicated by the numeral 29.

The portion of the plunger bore 21 that is in the injector body part 11 is enlarged and receives a return spring 31 which is coiled around the coupling 28 and the lower end of the link 27. The lower end of the return spring 31 rests on a ledge 32 formed internally of the body part 11 and the upper end of the return spring 31 engages a washer 33 which in turn engages a radially outwardly extending flange 34 formed near the upper end of the coupling 28. Thus, the force of the compression spring 31 urges the washer 33, the coupling 28 and the plunger 22 upwardly to the retracted position shown in FIGS. 1 and 3. Toward the end of each compression stroke of the associated piston, the injector drive train (not shown), which includes the link 27, causes the link 27 and the plunger 22 to move downwardly in an injection stroke to the forward position illustrated in FIG. 2. Any fuel contained in the chamber 26 is displaced by the plunger and expelled from the chamber 26 through the spray holes 24. When the plunger 22 is in the forward position illustrated in FIG. 2, the conical tip 36 of the plunger 22 engages a seat 37 formed within the cup 13 and thus seals the spray holes 24.

Fuel supply and fuel return lines are also formed in the injector. The fuel supply line includes a passage 41 which is shown schematically in the drawings. The passage 41 extends from a surface 42 of the body part 11 to an annular channel 43 formed in the upper surface of the cup 13. As disclosed in connection with U.S. Pat. No. 3,351,288, a fuel supply rail is formed in the engine head which carries fuel to an intake opening in the surface 42, and the fuel flows from the supply rail to the passage 41, the surface 42 being sealed by two O-rings 44. A one-way check valve 46 is preferably provided in the passage 41 for permitting fuel flow only in the direction of the chanel 43. The fuel supply passage 41 further includes a passage 47 formed in the barrel 12, which extends upwardly and communicates with the annular channel 43. The passage 47 is radially displaced from the plunger bore 21 and a metering orifice 48 connects the passage 47 with the plunger bore 21.

The return passage 49 is also shown schematically in the drawings and extends through the barrel 12 and the body part 11 between a short radial intake 52 and a surface 53 of the body part 11. The surface 53 includes an outlet opening (not shown) connected to a fuel return rail formed in the engine head, and one of the O-rings 44 and another O-ring 54 form a sealed connection on opposite sides of the surface 53. The intake 52 is connected to the plunger bore 21 and is generally aligned with a passage 49 that connects the plunger bore 21 with the passage 47.

A scavenging or return flow groove 62 is formed in the plunger 22 at a point that is displaced rearwardly from the plunger tip 61. The portion of the plunger 22 between the tip 61 and the groove 62 forms a metering land 63 which has a close sliding fit with the inner surface of the plunger bore 21. Of course, the portion of the plunger 22 above the groove 62 also has a close sliding fit with the bore 21 surface. Formed in the outer surface of the land 63 is a metering groove 64 which preferably extends parallel to the axis of the plunger 22.

The foregoing structure is generally similar in construction and operation to the injector disclosed in U.S. Pat. No. 3,351,288.

Figure 3:
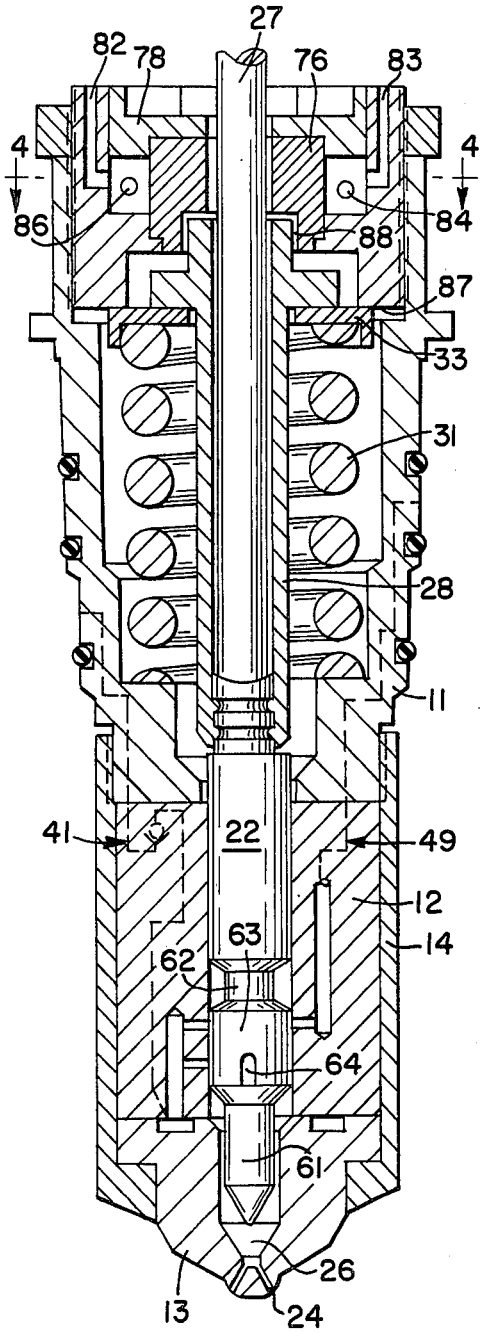

With reference to FIGS. 1 and 3 which show the plunger 22 in the retracted or rearward position, the length of the land 63 and the location of the scavenging groove 62 relative to the locations of the metering orifice 48 and the passages 49 and 52 are such that the groove 62 is spaced rearwardly of the passages 49 and 52 and the land 63 seals the two passages 49 and 52 when the plunger is retracted. Thus, the land 63 blocks flow of scavenging fluid from the passage 49 to the passage 52. However, the metering groove 64 extends from the lower edge 65 of the land 63 upwardly to the level of the metering orifice 48, and consequently the metering groove 64 connects the metering orifice 48 with the chamber 26. Therefore, when the plunger is in the retracted position shown in FIGS. 1 and 3, the groove 64 normally permits the flow of fuel from the supply passage 41 and the metering orifice 48 to the chamber 26, but the land 63 closes or blocks the scavenging flow of fuel between the passages 49 and 52.

Figure 2:
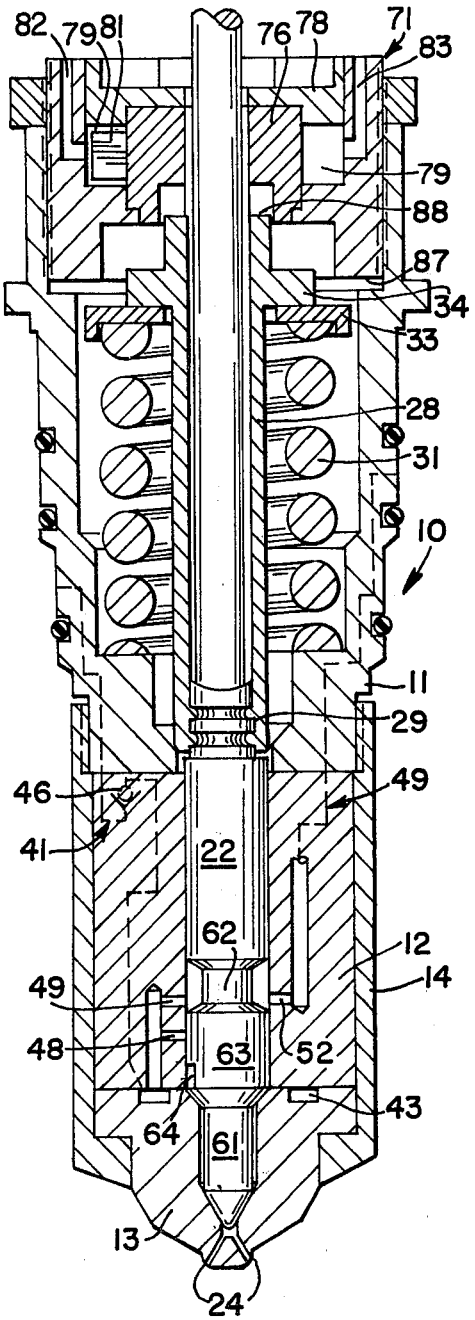
FIG. 2 and FIG. 3 are views similar to FIG. 1 but showing different operating positions of the injector.

As the injector plunger 22 is moved forwardly in the injection stroke, the metering groove 64 moves out of communication with the metering orifice 48 and the land 63 blocks or closes the metering orifice 48 as shown in FIG. 2. The land 63 moves forwardly past the passages 49 and 52 and the groove 62 provides for scavenging fuel flow from the supply passage 41 to the return passage 49.

During normal operation of the engine, the plunger 22 reciprocates between the retracted and forward positions shown in FIGS. 1 and 2, the fuel being metered into the chamber 26 during the retracted position, the fuel being injected into the engine cylinder as the plunger is moved forwardly, and scavenging fuel flowing during the forward position. The quantity of fuel injected in each cycle is determined by the amount of fuel metered into the chamber 26 in each cycle, and this quantity may in turn be controlled by adjusting the pressure of the fuel in the supply rail as described in U.S. Pat. No. 3,351,288.

During some engine operating conditions, such as when motoring or in engine braking operation, the engine throttle in the fuel supply system is "closed", but nevertheless the system is designed to permit leakage which allows a small amount of fuel to flow to the injector supply passage 41. This flow during closed throttle conditions is considered necessary to lubricate the plunger 22 during extended motoring conditions because the plunger 22 continues to reciprocate even though the engine may be motoring.

Figure 4:
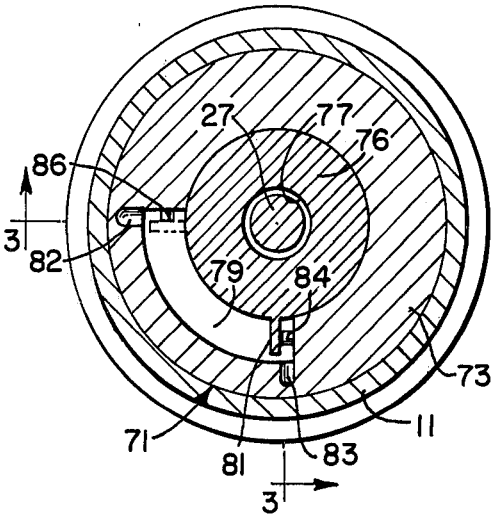
FIG. 4 is a sectional view taken on the line 4—4 of FIG. 3.

To close the metering orifice 48 in order to prevent the low volume leakage fuel from entering the chamber 26 during motoring or braking operations, means is provided for turning or rotating the plunger 22 to move the metering groove 64 out of alignment with the metering orifice 48. In the form of the invention illustrated in FIGS. 1 to 4, the rotating means comprises a rotary vane assembly 71 fastened to the body part 11 at the upper or rearward end of the injector. The rearward end of the body part 11 is internally threaded as indicated at 72 and a rotary vane housing 73 is threaded into the body part. A lock nut 74 is preferably provided to secure the housing 73 in place. A rotary vane shaft 76 is rotatably mounted within the housing 73 and a centrally located hole 77 in the shaft 76 loosely receives the link 27. The shaft 76 is supported between the housing 73 and a wall 78, the parts 73, 76 and 78 forming a vane chamber 79 between them (see FIG. 4). The shaft 76 has a radially extending vane 81 formed on one side thereof which extends into the chamber 79. Two fluid passages 82 and 83 are formed in the housing 73 leading to the chamber 79, the two passages 82 and 83 leading to opposite sides of vane 81. With reference to FIG. 4, when the fluid under pressure is admitted to the passage 82, the vane 81 with the shaft 76 attached thereto is pivoted in the counterclockwise direction until the vane meets a stop 84. In this position, the plunger 22 is pivoted to the position shown in FIG. 3 where the metering groove 64 is displaced by, in the present example, an angle of approximately 90° from the metering orifice 48. On the other hand, when the fluid under pressure is admitted to the other passage 83, the vane 81 is pivoted to the dotted line position shown in FIG. 4 where it engages another stop 86 and the plunger 22 is in the position illustrated in FIGS. 1 and 2 where the metering groove 64 connects the metering orifice 48 with the chamber 26 when the plunger is retracted. Besides limiting the angular movements of the vane 81, the two stops 84 and 86 further serve the function of enabling the fluid to get behind the vane 81 and exert pressure on it in order to pivot the shaft 76.

With reference to FIGS. 1 and 3, when the plunger 22 is in the retracted position, the return spring 31 holds the washer 33 in engagement with the lower surface 87 of the vane housing 73. Thus, the surface 87 forms a top stop which limits the upward movement of the washer 33. The stop 87 further serves to remove the upwardly directed spring force on the coupling 28 so that the coupling 28 and the plunger 22 may be more readily rotated by the force on the vane 81. Of course, when the link 27 is driven forwardly during an injection stroke, the flange or washer 33 is moved off of the top stop 87 and there is high contact pressure between the flange 34 and the washer 33 which holds the plunger 22 and the coupling 28 in an angularly adjusted position. The shaft 76 is slidably connected to the upper end of the coupling 28 by a tang and groove arrangement indicated generally by the reference numeral 88 which enables the coupling 28 to reciprocate upwardly and downwardly relative to the shaft 76 while maintaining these two parts in engagement and preventing relative angular movements between these two parts.

Figure 5:
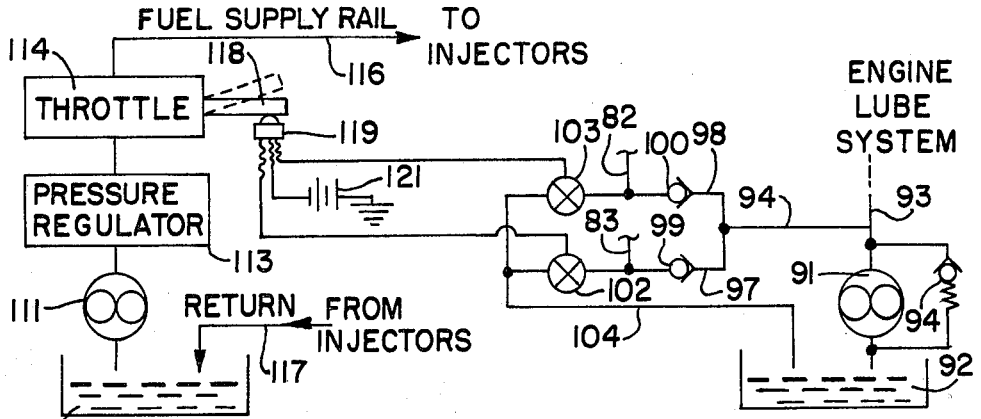
FIG. 5 is a schematic diagram of a system including an injector embodying the invention.

FIG. 5 illustrates a fluid control system for controlling the application of control fluid pressure to the chamber 79. In the specific example illustrated in FIG. 5, the control fluid is the engine lubricant and the lubricant pressure is employed to rotate the vane shaft 76. The system illustrated in FIG. 5 includes a lube pump 91 connected to pump lubricant from a sump or reservoir 92 and deliver it to a line 93 leading to the engine lubricant system. A pressure control valve 94 is connected across the pump 91 to regulate the lube pressure. The foregoing are parts of the customary lubricant system of an engine. Leading from the high pressure side of the pump 91 is a line 94 connected to two parallel flow lines 97 and 98. The lines 97 and 98 have one-way check valves 99 and 100 and solenoid flow control valves 102 and 103 connected in them. The other ends of the parallel lines 97 and 98 are connected by a common line 104 to the sump 92. Connected between the valves 99 and 102 is the line 83 and connected between the valves 100 and 103 is the line 82. When the engine is operating and the valve 102 is open and the valve 103 is closed, lubricant flows through the valve 102 to the return line 104 causing low pressure to appear in the line 83. However, with the valve 103 closed, a high pressure condition exists in the other line 82. The high pressure in the line 82 and the low pressure in the line 83, of course, rotate the vane shaft 76 in one direction as previously explained. Conversely, when the valve 103 is open and the valve 102 is closed, a high pressure condition exists in the line 83 and the other line is connected to the low pressure sump, and the vane shaft 76 rotates in the other direction. Orifices or flow restrictions may be provided in the lines 97 and 98 to prevent a loss of pressure in one line when the solenoid valve in the other parallel line is opened.

In the present specific example, the two solenoid valves 102 and 103 are connected to be controlled by the fuel supply system of the engine. The fuel supply system includes a fuel pump 111 connected to pump fuel from a supply 112. A pressure regulator 113 regulates the fuel pressure and a throttle 114 further regulates the fuel pressure in a fuel supply rail 116 that leads to fuel supply passages 41 of the injectors. The fuel supply system further includes a return line 117 that is connected to receive the return flow from the return passages 49. The throttle 114 includes a control lever 118 which, in operation of the engine, may be manually adjusted to control the fuel pressure and therefore the fuel quantity delivered to the engine. Mounted adjacent the control lever 118 is an electric switch 119 which is connected to the two solenoid valves 102 and 103 and to a battery 121. When the control lever 118 is in the solid line position shown in FIG. 5 where it engages the switch 119, the power from the battery 121 is connected to the solenoid 102 causing pressure to appear in the line 82 and moving the plunger to the position where the metering groove 64 is out of alignment with the metering orifice 48. When the engine is motoring or in brake operation, the control lever 118 is in the solid line position. During operation of the engine under power, the control level 118 is in the dashed line position where it disengages the switch 119, and the switch 119 connects power to the other solenoid 103 causing pressure to appear in the other passage 83 which moves the plunger to the other position where the metering groove 64 registers with the orifice 48.

Figure 6:
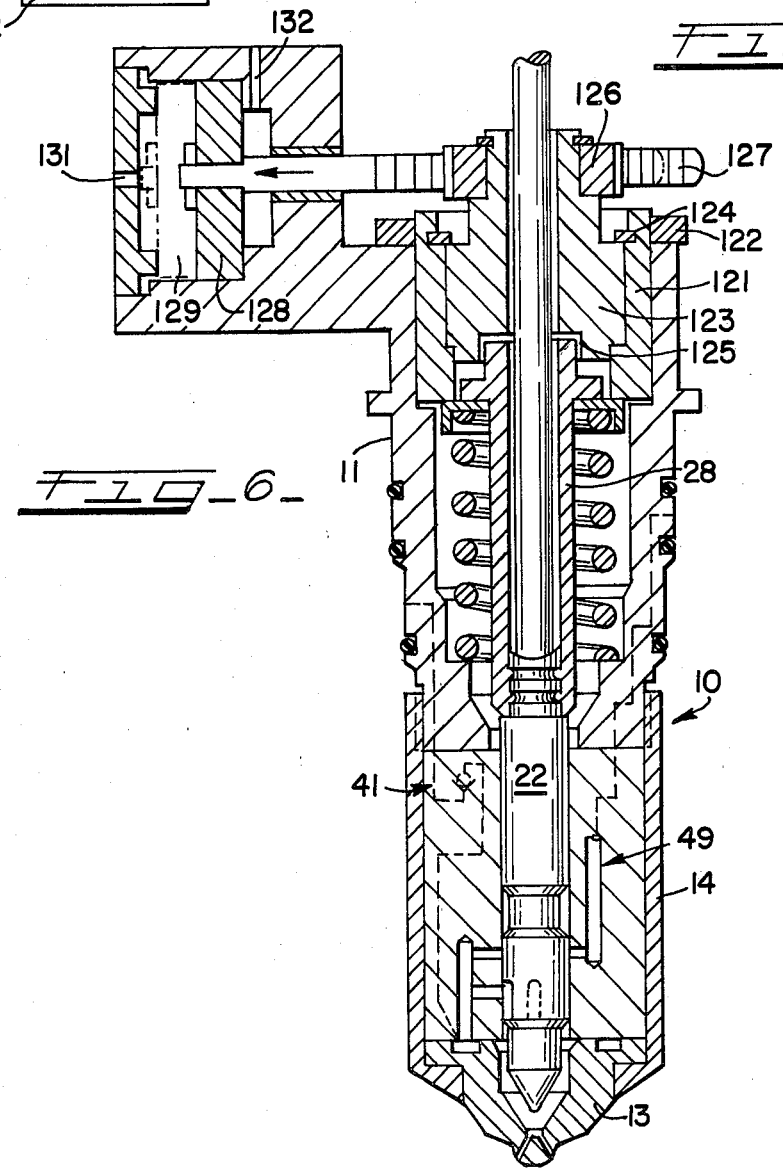
FIG. 6 is a view similar to FIG. 1 but showing an alternative injector construction.

In the alternate form of the injector shown in FIG. 6, the injector body and plunger are constructed similarly to the injector shown in FIGS. 1 through 3, but different means is provided to rotate the plunger. This plunger rotating means includes a housing 121 that is secured to the body part of the injector and held in place by a lock nut 122. A rotating shaft 123 is connected to the upper end of the plunger coupling 28 by a tang and groove arrangement 125 as previously described. A snap ring 124 holds the shaft 123 in place in the housing 121 but permits the shaft 123 to rotate. A pinion 126 is secured to the upper end of the shaft 123 and meshes with a rack 127. One end of the rack 127 is secured to a piston 128 that is mounted in a cylinder 129. Opposite sides of the cylinder 129 are connected to a fluid under pressure by passages 131 and 132, and the piston 128 is moved between the solid line position and the dashed line position shown in FIG. 6. When fluid under pressure is applied to the passage 132, the piston 128 and the rack 127 are moved toward the left as seen in FIG. 6 causing the coupling 28 and the plunger to pivot and move the metering groove out of registry with the metering orifice. On the other hand, when pressure is applied to the other passage 131, the piston 128 is moved toward the right and the plunger is pivoted to the position where the metering groove registers with the metering orifice. Various means may be provided for limiting the movement of the plunger, such as stops positioned to engage the rack 127 or the shaft 123. In the present illustration, the axial length of the housing forming the chamber 129 is dimensioned to provide the necessary length of movement.

It will be apparent from the foregoing that a novel and useful apparatus has been provided. The injector may operate to inject fuel during normal engine operating conditions by rotating the plunger to the position where the metering groove registers with the metering orifice when the plunger is in the retracted position. However, under motoring or braking operations, the plunger may be pivoted to close off the metering orifice and thereby prevent any fuel from leaving the metering orifice and also to prevent cylinder gases from entering the fuel supply passage. Consequently, even though scavenging fuel may flow during the motoring operation in order to lubricate and cool the injector, such fuel is prevented from entering the metering chamber.

We claim:

1. Apparatus for a fuel injector that includes an injector body having a plunger bore formed therein, a supply passage and a return passage formed in said body adjacent said bore, a metering orifice connecting said bore with said supply passage, and first and second return flow passages connecting the supply passage and the return passage with the bore, said return flow passages being adjacent each other but spaced from said orifice, said injector body having a forward end and spray holes connected to said bore adjacent said forward end, said apparatus comprising a generally cylindrical plunger adapted to reciprocate in said bore adjacent said orifice, said flow passages and said spray holes, said plunger having a reduced diameter end portion adjacent said forward end of said body, a cylindrical land formed on said plunger adjacent said reduced diameter end portion, a feed groove formed in said land, said feed groove extending to one edge of the land and opening to said reduced diameter end portion, said groove being adapted to connect with said orifice, and an annular return groove formed on said plunger adjacent said land and at a location which is displaced from said reduced diameter end portion and said feed groove, said return groove being disconnected from said feed groove and being adapted to connect with said first and second return flow passages in all modes of operation.

2. Apparatus as in claim 1, and further including means coupled to said plunger for rotating said plunger relative to said body.

3. A fuel injector for an internal combustion engine comprising an injector body having a plunger bore formed therein, a cyclically operable plunger reciprocably mounted within said bore and movable during each cycle of operation between a retracted position and a forward position, a fuel supply passage formed in said injector body, a fuel return passage formed in said injector body and connected to receive fuel from said supply passage in each cycle of operation when said plunger is in said forward position, said injector bore forming a fuel metering chamber at the forward end thereof when said plunger is in said retracted position, said supply passage including an outlet leading to said metering chamber, and means selectively closing said outlet for at least one full cycle of operation under selected engine operating conditions, whereby fuel flows through said return passage during every cycle of operation and fuel flows into said metering chamber only when said means does not close said port.

4. Apparatus as in claim 3, wherein the engine includes a fuel supply system having a throttle, and said closing means includes hydraulically operated means adapted to be connected to respond to the engine fuel supply system.

5. A fuel injector for an internal combustion engine comprising an injector body having a plunger bore formed therein, a plunger reciprocably mounted within said bore and movable between a retracted position and a forward position, a fuel supply passage formed in said injector body, a fuel return passage formed in said injector body and connected to receive fuel from said supply passage in each cycle of operation when said plunger is in said forward position, said injector bore forming a fuel metering chamber at the forward end thereof when said plunger is in said retracted position, said supply passage including an outlet leading to said metering chamber, and means closing said outlet under selected engine operating conditions, fuel flowing through said return passage during every cycle of operation and fuel flowing into said metering chamber only when said means does not close said port, said engine including a fuel supply system having a throttle, and said closing means including hydraulically operated means adapted to be connected to respond to the engine fuel supply system, said throttle being movable to closed and open positions, and said hydraulically operated means causing said closing means to close said outlet during the closed position of the throttle and to open said outlet during the open position of the throttle.

6. A fuel injector for an internal combustion engine comprising an injector body having a plunger bore formed therein, a plunger reciprocably mounted within said bore and movable between a retracted position and a forward position, a fuel supply passage formed in said injector body, said injector bore forming a fuel metering chamber at the forward end thereof when said plunger is in said retracted position, said supply passage including an outlet leading to said metering chamber, and means closing said outlet under selected engine operating conditions, said means comprising a metering land formed on said plunger, a metering groove formed in said land, and means for angularly turning said plunger between open and closed positions, said groove connecting said outlet of said supply passage with said metering chamber when said plunger is retracted and is in said open position, and said groove being displaced from said outlet and said land closing said outlet when said plunger is in said closed angular position.

7. Apparatus as in claim 6, wherein said land is generally cylindrical, and said groove extends substantially parallel to the axis of said cylindrical land.

8. Apparatus as in claim 6, wherein said means for turning said plunger comprises hydraulic means coupled to turn said plunger, and control circuit means connected to operate said hydraulic means.

9. Apparatus as in claim 8, wherein said hydraulic means comprises a vaned shaft coupled to said plunger and a chamber receiving said vaned shaft, and said control means comprises means for applying hydraulic pressure in said chamber for turning said vane shaft.

10. Apparatus as in claim 8, wherein said hydraulic means comprises a rack and pinion means coupled to said injector, and said control means being connected to move said rack and turn said pinion and thereby turn said plunger.

11. Apparatus as in claim 8, wherein the engine includes a fuel supply system having a throttle that is movable to open and closed positions, and said control means is connected to respond to the position of the throttle.

12. Apparatus as in claim 6, and further including an injector drive train and return means for reciprocating said plunger, said drive train and said plunger being under compressive tension during movement of said plunger and said injector further including top stop means for relieving said tension when said plunger is in said retracted position, said turning means being operable to turn said plunger when in said retracted position.

* * * * *